US008842861B2

(12) United States Patent
Westermann et al.

(10) Patent No.: US 8,842,861 B2
(45) Date of Patent: Sep. 23, 2014

(54) METHOD OF SIGNAL PROCESSING IN A HEARING AID SYSTEM AND A HEARING AID SYSTEM

(71) Applicants: Adam Westermann, Sydney (AU); Jörg Matthias Buchholz, Sydney (AU); Torsten Dau, Copenhagen (DK)

(72) Inventors: Adam Westermann, Sydney (AU); Jörg Matthias Buchholz, Sydney (AU); Torsten Dau, Copenhagen (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 13/740,417

(22) Filed: Jan. 14, 2013

(65) Prior Publication Data

US 2013/0129124 A1 May 23, 2013

Related U.S. Application Data

(63) Continuation-in-part of application No. PCT/EP2011/050331, filed on Jan. 12, 2011.

(30) Foreign Application Priority Data

Jul. 15, 2010 (DK) ..... 2010 00636

(51) Int. Cl.
*H04R 25/00* (2006.01)

(52) U.S. Cl.
CPC ..... *H04R 25/505* (2013.01); *H04R 2225/43* (2013.01); *H04R 2460/03* (2013.01); *H04R 25/43* (2013.01); *H04R 25/554* (2013.01); *H04R 2225/41* (2013.01); *H04R 25/552* (2013.01)
USPC ..... 381/312; 381/320

(58) Field of Classification Search
USPC ..... 381/312–331
See application file for complete search history.

(56) References Cited

U.S. PATENT DOCUMENTS

2002/0037087 A1 3/2002 Allegro et al.
2002/0090098 A1 7/2002 Allegro et al.

(Continued)

FOREIGN PATENT DOCUMENTS

JP 2004-289762 A 10/2004
JP 2004-312754 A 11/2004

(Continued)

OTHER PUBLICATIONS

International Search Report with Written Opinion of International Searching Authority dated Mar. 9 2011.

(Continued)

*Primary Examiner* — Brian Ensey
*Assistant Examiner* — Norman Yu
(74) *Attorney, Agent, or Firm* — Sughrue Mion, PLLC

(57) ABSTRACT

A method of processing signals in a hearing aid system (200, 300) comprises the steps of transforming two audio signals to the time-frequency domain, calculating the interaural coherence, deriving a first gain based on the interaural coherence, applying the first gain value in the amplification of the time-frequency signals, and transforming the signals back into the time domain for further processing in the hearing aid. The first gain value as a function of the value representing the interaural coherence comprises three contiguous ranges for the values representing the interaural coherence, where the maximum slope in the first and third range are smaller than the maximum slope in the second range, the first range comprising low interaural coherence values, the third range comprising high interaural coherence values, and the second range comprising intermediate interaural coherence values. The invention further provides a hearing aid system (200, 300) adapted for suppression of interfering speakers.

12 Claims, 5 Drawing Sheets

(56) References Cited

U.S. PATENT DOCUMENTS

| | | | |
|---|---|---|---|
| 2004/0196994 | A1 | 10/2004 | Kates |
| 2008/0212811 | A1 | 9/2008 | Kates |
| 2009/0304203 | A1 | 12/2009 | Haykin et al. |
| 2010/0002886 | A1 | 1/2010 | Doclo |

FOREIGN PATENT DOCUMENTS

| | | | |
|---|---|---|---|
| WO | 03/067922 | A2 | 8/2003 |
| WO | 2011/044898 | A1 | 4/2011 |

OTHER PUBLICATIONS

Wittkop et al, "Speech Process for Hearing Aids; Noise Reduction Motiviated by Models of Binaural Interaction", ACTA Acustica, Editions De Physique, Les Ulis Cedex, FR, vol. 83 No. 4, Jan. 1, 1997, pp. 684-699, XP0000884158.

Allen, J.B. et al, "Multimicrophone signal-processing technique to remove room reverberation from speech signals", Journal Acoustical Society America, vol. 62, No. 4, pp. 912-915, Oct. 1977.

Boashash, Boualem, "Time-Frequency signal Analysis and Processing: A Comprehensive Reference", Elsevier Science, Oxford, 2003.

Welch, P.D., "The Use of Fast Fourier Transform for the Estimation of Power Spectra: A Method Based on Time Averaging Over Short, Modified Periodograms", IEEE Transactions on Audio Electroacoustics, vol. AU-15: (Jun. 1967, pp. 70-73.

Rabiner, L.R. et al, An Introduction to Hidden Markov Models, IEEE ASSP Magazine Jan. 1986.

Buchler, Michael Christoph, "Algorithms for Sound Classification in Hearing Instruments", Doctoral Dissertation, ETH—Zurich, 2002.

Office Action for counterpart Japanese Patent Application No. 2013-515777 dated Feb. 4, 2014, with English translation.

METHOD OF SIGNAL PROCESSING IN A HEARING AID SYSTEM AND A HEARING AID SYSTEM

RELATED APPLICATIONS

The present application is a continuation-in-part of application PCT/EP2011050331, filed on Jan. 12, 2011, in Europe and published as WO2012007183 A1. The present invention is based on and claims priority from PA201000636, filed on Jul. 15, 2010, in Denmark, the contents of which are incorporated hereinto by reference.

BACKGROUND OF THE INVENTION

1. Field of the Invention

The present invention relates to a method of signal processing in a hearing aid system. The invention, more specifically, relates to a method of noise suppression in a hearing aid system. The invention further relates to hearing aid systems having means for noise suppression.

In the context of the present disclosure, a hearing aid should be understood as a small, microelectronic device designed to be worn behind or in a human ear of a hearing-impaired user. A hearing aid system may be monaural and comprise only one hearing aid or be binaural and comprise two hearing aids. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer. The signal processor is preferably a digital signal processor. The hearing aid is enclosed in a casing suitable for fitting behind or in a human ear.

It is well known that people with normal hearing can usually follow a conversation despite being in a situation with several interfering speakers and significant background noise. This situation is known as a cocktail party environment. As opposed hereto hearing impaired people will typically have difficulties following a conversation in such situations.

2. The Prior Art

In the article by Allen et al.: "Multimicrophone signal-processing technique to remove room reverberation from speech signals", Journal Acoustical Society America, vol. 62, no. 4, pp. 912-915, October 1977, a method for suppression of room reverberation, from the signals recorded by two spatially separated microphones, is disclosed. To accomplish this the individual microphone signals are divided into frequency bands whose corresponding outputs are cophased (delay differences are compensated) and added. Then the gain of each resulting band is set based on the cross correlation between corresponding microphone signals in that band. The reconstructed broadband speech is perceived with considerably reduced reverberation.

US-A1-20080212811 discloses a signal processing system with a first signal channel having a first filter and a second signal channel having a second filter for processing first and second channel inputs and producing first and second channel outputs, respectively. Filter coefficients of at least one of the first and second filters are adjusted to minimize the difference between the first channel input and the second channel input in producing the first and second channel outputs. The resultant signal match processing of the signal processing system gives broader regions of signal suppression than using Wiener filters alone for frequency regions where the interaural correlation is low, and may be more effective in reducing the effects of interference on the desired speech signal.

One problem with the above mentioned systems is that noise from interfering speakers is not efficiently suppressed.

It is therefore a feature of the present invention to overcome at least this drawback and provide a more efficient method for suppression of noise from interfering speakers.

Hereby speech intelligibility for the hearing impaired can be improved in the otherwise very difficult situation of following a conversation despite several interfering speakers.

It is another feature of the present invention to provide a hearing aid system incorporating means for suppression of noise from interfering speakers.

SUMMARY OF THE INVENTION

The invention, in a first aspect, provides a method for processing signals in a hearing aid system comprising the steps of: providing a first signal representing the output from a first input transducer in a first hearing aid of the hearing aid system; providing a second signal representing the output from a second input transducer of the hearing aid system; transforming the first and second signal from the time domain and to the time-frequency domain hereby providing a third and fourth signal, respectively; calculating a value representing the interaural coherence between the third and fourth signal hereby providing a fifth signal; deriving a first gain value for the hearing aid system based on the fifth signal; applying the first gain value in the amplification of the third signal in the first hearing aid hereby providing a sixth signal; transforming the sixth signal from the time-frequency domain and to the time domain hereby providing a seventh signal for further processing in the hearing aid system; and wherein the relation determining the first gain value as a function of the value representing the interaural coherence comprises three contiguous ranges for the values representing the interaural coherence, where the maximum slope in the first and third range are smaller than the maximum slope in the second range and wherein the ranges are defined such that the first range comprises values representing low interaural coherence values, the third range comprises values representing high interaural coherence values, and the second range comprises values representing intermediate interaural coherence values.

This provides an improved method for suppression of noise from interfering speakers in a hearing aid system.

The invention, in a second aspect, provides a hearing aid system comprising at least one hearing aid, two microphones, analogue-to-digital converter means, time-frequency transforming means, interaural coherence calculation means, first gain calculation means adapted for suppressing interfering speakers, digital processing means adapted for alleviating a hearing deficit of the user wearing the hearing aid system, digital-to-analogue converter means, and output transducer means for providing an acoustical signal, wherein the first gain calculation means is adapted for using a relation determining a first gain value as a function of a value representing the interaural coherence comprising three contiguous ranges for the values representing the interaural coherence, where the maximum slope in the first and third range are smaller than the maximum slope in the second range, and wherein the ranges are defined such that the first range comprises values representing low interaural coherence values, the third range comprises values representing high interaural coherence values, and the second range comprises values representing intermediate interaural coherence values.

The invention, in a third aspect, provides a hearing aid system comprising a hearing aid and an external device, said hearing aid having a microphone, analogue-to-digital converter means, time-frequency transforming means, interaural coherence calculation means, first gain calculation means adapted for suppressing interfering speakers, digital processing means adapted for alleviating a hearing deficit of the user wearing the hearing aid system, digital-to-analogue converter means, and output transducer means for providing an acoustical signal, and said external device having an acoustical-electrical input transducer means and link means for transmitting data derived from the input transducer to the hearing aid, wherein the first gain calculation means is adapted for using a relation determining a first gain value as a function of a value representing the interaural coherence comprising three contiguous ranges for the values representing the interaural coherence, where the maximum slope in the first and third range are smaller than the maximum slope in the second range, and wherein the ranges are defined such that the first range comprises values representing low interaural coherence values, the third range comprises values representing high interaural coherence values, and the second range comprises values representing intermediate interaural coherence values.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context the term interaural coherence, or just coherence, represents a measure of the similarity between two signals from two acoustical-electrical input transducers of a hearing aid system, where the two input transducers are positioned near or at each of the two ears of the user wearing the hearing aid system. The interaural coherence can be defined as the normalized interaural cross-correlation in the frequency domain.

In the present context the term time-frequency transformation represents the transformation of a signal in the time domain, such as an audio signal derived from a microphone, and into the so called time-frequency domain. The result of the time-frequency transformation is denoted a time-frequency distribution. Using the inverse transform the time-frequency distribution is transformed back to the time domain. The concept of time-frequency analysis is well known within the art and further details can be found in e.g. the book by B. Boashash: "Time-Frequency Signal Analysis and Processing: A Comprehensive Reference", Elsevier Science, Oxford, 2003.

One problem with prior art systems for suppression of noise from interfering speakers, based on the interaural coherence is that the suppression only depends on the instantaneous value of the interaural coherence. By considering the statistical distribution of the interaural coherence and using a more versatile relation between the suppression and the interaural coherence, the efficiency of the noise suppression can be improved.

In particular it has been found that a nearby speaker can be distinguished from distant speakers based on the interaural coherence properties of the audio signals received from the speakers. Using this knowledge interfering speakers can be suppressed based on the distance to the hearing aid system user, and a sort of "distance filter" can hereby be realized.

Additionally it has been found that equidistant speakers can likewise be distinguished based on the interaural coherence properties of the audio signals received from the speakers because signals received from speakers facing away from the hearing aid system user will be biased towards lower interaural coherence. Hereby interfering speakers can be suppressed based on whether or not they are facing the hearing aid system user.

Figure 1:
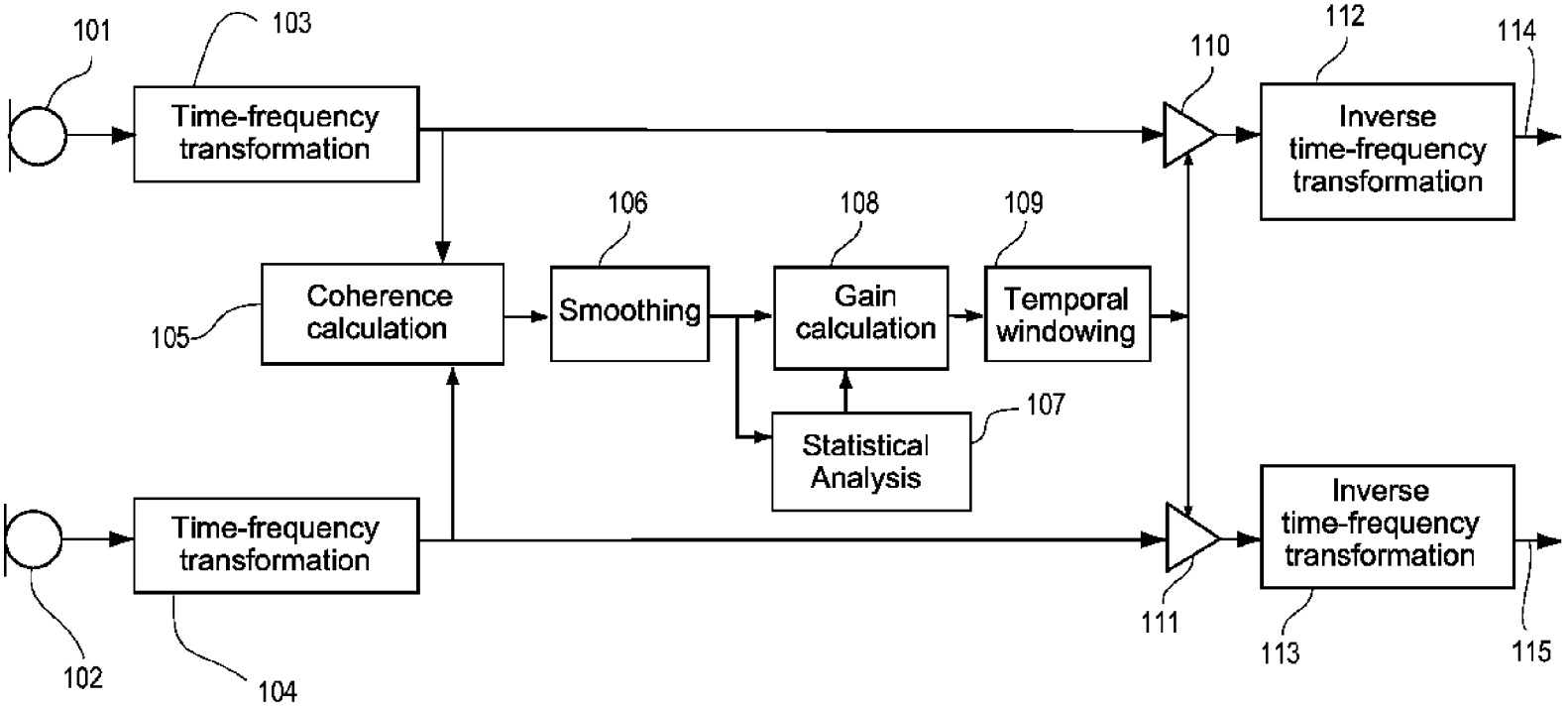
FIG. 1 illustrates highly schematically selected parts of a hearing aid system according to an embodiment of the invention.

Reference is first made to FIG. 1, which illustrates highly schematically selected parts of a hearing aid system according to an embodiment of the invention. The hearing aid system comprises a first input transducer 101, a second input transducer 102, time-frequency transformation means 103 and 104, interaural coherence calculation means 105, frequency smoothing means 106, signal statistics calculation means 107, gain calculation means 108, temporal windowing means 109, a first gain multiplier 110, a second gain multiplier 111 and inverse time-frequency transformation means 112 and 113.

Acoustic sound is picked up by the first input transducer 101 and the second input transducer 102. The analog signal from the first input transducer 101 is converted to a first digital audio signal in a first analog-to-digital converter (not shown), and the analog signal from the second input transducer 102 is converted to a second digital audio signal in a second analog-to-digital converter (not shown).

The analog signals are sampled with a rate of 44 kHz and a resolution of 16 bit. In variations of the embodiment the sampling rate may be decreased to 16 kHz, which is a typical sampling rate in a hearing aid or even down to 8 kHz, which is typically used in telephones, without significant loss of speech intelligibility.

The first digital audio signal is input to the first time-frequency transformation means 103, and the second digital audio signal is input to the second time-frequency transformation means 104. The first and second time-frequency transformation means provide an estimate of the time-frequency distribution of the first digital audio signal $X_1(m,k)$ and an estimate of the time-frequency distribution of the second digital audio signal $X_2(m,k)$, where m and k denote the time index and frequency index respectively.

The estimate of the time-frequency distribution is calculated using the Welch-method with a Hanning window having a length of 6 ms and an overlap of 50%. The Welch-method is generally advantageous in that it suppresses noise at the cost of reduced frequency resolution. The Welch-method is therefore very well suited for the application considered here where the requirements with respect to frequency resolution are limited. The Welch-method is well known and is further described in e.g. the article by P. D. Welch: "The Use of Fast Fourier Transform for the Estimation of Power Spectra: A Method Based on Time Averaging Over Short, Modified Periodograms", IEEE Transactions on Audio Electroacoustics, Volume AU-15 (June 1967), pages 70-73.

In variations of the embodiment of FIG. 1 other overlapping windowed Fourier transforms may be used for providing the time-frequency distributions of the digital audio signals. In yet other variations non-overlapping windowed Fourier transforms such as e.g. the Bartlett method can be used.

In further variations of the embodiment of FIG. 1 digital band pass filters are used for providing the time-frequency distribution of the digital audio signals. Hereby a significant reduction in processing power and time delay is achieved at the cost of reduced frequency resolution.

The interaural coherence calculation means 105 calculates a first time-averaged auto-correlation $G_{11}(m,k)$ of the first estimated time-frequency distribution, a second time-averaged auto-correlation $G_{22}(m,k)$ of the second estimated time-frequency distribution and a time-averaged cross-correlation $G_{12}(m,k)$ of the first and the second estimated time-frequency distributions. The correlations are calculated by a set of recursive filters controlled by a recursive parameter $\alpha$:

$$G_{11}(m,k)=\alpha|X_1(m,k-1)|^2+|X_1(m,k)|^2$$

$$G_{22}(m,k)=\alpha|X_2(m,k-1)|^2+|X_2(m,k)|^2$$

$$G_{12}(m,k)=\alpha X_1(m,k-1)X_2^*(m,k-1)+X_1(m,k)X_2^*(m,k)$$

The recursive parameter $\alpha$ is selected based on its relation to a time constant $\tau$, that determines the time averaging of the correlations, and the window interval T that is used for estimating the time-frequency distribution:

$$\tau = \frac{-T}{\mathrm{Ln}(\alpha)}$$

Having a Hanning window with a length of 6 ms and an overlap of 50%, the window interval T is 3 ms. A time constant $\tau$ of 100 ms has been selected, where the time constant $\tau$ is defined as the time required to rise or fall exponentially through 63% of the time constant amplitude. This value of the time constant is advantageous in that it corresponds well to the normally occurring modulations in speech, where the phonemes have durations in the range of say 30 ms to 500 ms. Hereby a value of 0.97 is provided for the recursive parameter $\alpha$.

In variations of the embodiment of FIG. 1, the time constant $\tau$ can be varied within the range of 30 ms to 500 ms as defined by the duration of normally occurring phonemes.

The time-averaged correlations are combined to provide the time-averaged interaural coherence C (m,k):

$$C(m,k) = \frac{G_{12}(m,k)}{\sqrt{G_{11}(m,k)G_{22}(m,k)}}$$

The calculated time-averaged interaural coherence values are input to the frequency smoothing means 106. The frequency smoothing means 106 comprises a third-octave filter bank with a number of rectangular filters (in the following represented by the number b=1, 2, . . . $b_{max}$). The center frequency $f_c$ of the rectangular filters in the third-octave filter bank is defined according to:

$$f_c(b)=2^{b/3}\times 1000\ \mathrm{Hz}$$

The bandwidth BW of the rectangular filters in the third-octave filter bank is defined according to:

$$BW = f_c(b)\frac{2^{1/3}-1}{2^{1/6}}$$

The time-averaged interaural coherence values with frequency indices falling within the same rectangular filter are smoothed and the smoothed values are used, instead of the original values, for further processing in the system. This is advantageous because large differences between adjacent or nearby (with respect to frequency) time-averaged interaural coherence values may lead to artifacts caused by significantly differing gain values in the frequency channels in the hearing aid. The smoothed values are calculated as the average of the values within the rectangular filter.

In another variation other filter banks can be used such as Equivalent Rectangular Bandwidth (ERB) filterbanks.

The smoothed coherence values are provided as input to the signal statistics calculation means 107 and the gain calculation means 108. In the signal statistics calculation means 107 the standard deviation $\sigma_C(m, k)$ and the mean $\overline{C(m,k)}$ of the smoothed coherence values are derived from a period of 2 seconds, which corresponds to approximately 650 time frames or time indices m. This is done independently for each of the frequency indices k. Subsequently the standard deviation $\sigma_C(m, k)$ and the mean $\overline{C(m,k)}$ are input to the gain calculation means 108. In the gain calculation means 108 a gain value G(m,k) is calculated for each of the smoothed coherence values:

$$G(m,k) = \frac{1}{1+e^{-\frac{k_{slope}}{\sigma_C(m,k)}\left(C(m,k)-k_{shift}\overline{C(m,k)}\right)}}$$

where the constants $k_{slope}$ and $k_{shift}$ are used to provide handles to control the shape and position of the gain versus coherence curve that can be derived from the above given expression for the gain value G(m,k). The values of the constants $k_{slope}$ and $k_{shift}$ are selected to be 3.4 and 0.7 respectively. The gain versus coherence curve is a Sigmoid function and the slope is in an inverse relationship with the standard deviation $\sigma_C(m, k)$ and in a direct relationship with the constant $k_{slope}$. The center point of the Sigmoid curve is in a direct relationship with the mean $\overline{C(m,k)}$ and the constant $k_{shift}$. This provides a gain function that is very well suited to suppress distant sound sources relative to more nearby sound sources as will be further described below with reference to FIGS. 3-5.

Hereby is further provided a method of calculating the gain value G(m,k) that adapts in real time to the current sound environment, in such a way that the gain versus coherence curve is optimized for suppressing interfering distant speakers.

In variations of the embodiment of FIG. 1, alternatives to the standard deviation and the mean of the smoothed coherence values are derived, such as e.g. a variance with respect to the standard deviation and an average, median or percentile with respect to the mean. The values of the constants $k_{slope}$ and $k_{shift}$ may likewise be given alternative values, e.g. within the range of 1 to 5 for $k_{slope}$ and within the range of 0.5 and 1.5 for $k_{shift}$.

In still another variation of the embodiment of FIG. 1, the shape of the gain versus coherence curve is determined based on an acoustic scene classifier, wherein the acoustic scene is identified using features of sound signals collected from that particular acoustic scene. The concept of acoustic scene classifiers is well known in the art and further details can be found e.g. in US-A1-2002/0037087 or US-A1-2002/0090098 A1. The fundamental method used in scene classification is the so-called pattern recognition (or classification), which ranges from simple rule-based clustering algorithms to neural networks, and to sophisticated statistical tools such as hidden Markov models (HMM). Further information regarding these known techniques can be found in one of the following publications: X. Huang, A. Acero, and H.-W. Hon, "Spoken Language Processing: A Guide to Theory", Algorithm and System Development, Upper Saddle River, N.J.: Prentice Hall Inc., 2001. L. R. Rabiner and B.-H. Juang, "Fundamentals of Speech Recognition", Upper Saddle River, N.J.: Prentice Hall Inc., 1993. M. C. Buchler, Algorithms for Sound Classification in Hearing Instruments, doctoral dissertation, ETH-Zurich, 2002. L. R. Rabiner and B.-H. Juang, "An introduction to Hidden Markov Models", IEEE Acoustics Speech and Signal Processing Magazine, January 1986. S. Theodoridis and K. Koutroumbas, "Pattern Recognition", New York: Academic Press, 1999.

In one specific variation the acoustic scene classifier provides information concerning the presence of interfering speakers. In another specific variation the acoustic scene classifier provides information concerning the presence of reverberated signals.

In further variations of the embodiment of FIG. 1, mixture models, such as a Gaussian mixture model, or cumulative models can be used to characterize the coherence distribution and thereby control the calculation of the gain value G(m,k).

In yet another variation of the embodiment of FIG. 1, the hearing aid system comprises interaction means adapted for allowing the user to increase or decrease one or both of the constants $k_{slope}$ and $k_{shift}$. Hereby either more comfort (less artifacts) or higher speech intelligibility can be emphasized through the interaction of the hearing system user. According to a more specific variation the value of $k_{shift}$ is decreased when the user desires more comfort and increased when higher speech intelligibility is desired.

In order to avoid temporal aliasing, each time index of the gain G(m,k) is transformed back to the time domain using an inverse Fourier transform, the left and the right part of the gain vector are swapped, the vector is truncated and zero padded and the gain vector is transformed back to the time-frequency domain. Hereby the temporal windowing means 109 provides a modified gain $G_s(m,k)$.

The modified gain $G_s(m,k)$ is provided to a control input of the first and second gain multipliers 110 and 111 and the corresponding gain is applied to the time-frequency distribution of the first digital audio signal $X_1(m,k)$ and the time-frequency distribution of the second digital audio signal $X_2(m,k)$. This provides third and fourth digital signals that are transformed back to the time domain in the first inverse time-frequency transformation means 112 and in the second inverse time-frequency transformation means 113, respectively. Hereby is provided a first distance filtered time domain signal 114 and a second distance filtered time domain signal 115, which are subsequently processed, using standard hearing aid signal processing, in order to compensate the individual hearing deficit of the hearing aid user.

In a variation of the embodiment of FIG. 1, one of the input transducers is not located in a hearing aid, but in an external device of the hearing aid system, wherein the external device is adapted to be positioned at or near the contra-lateral ear of the user wearing the hearing aid system and having a hearing aid in the ipse-lateral ear and wherein the external device comprises the housing, the acoustical-electrical input transducer means and link means for transmitting data derived from the input transducer to the hearing aid. Hereby is provided a hearing aid system adapted for users with a unilateral hearing impairment that do not require a binaural hearing aid system.

Figure 2:
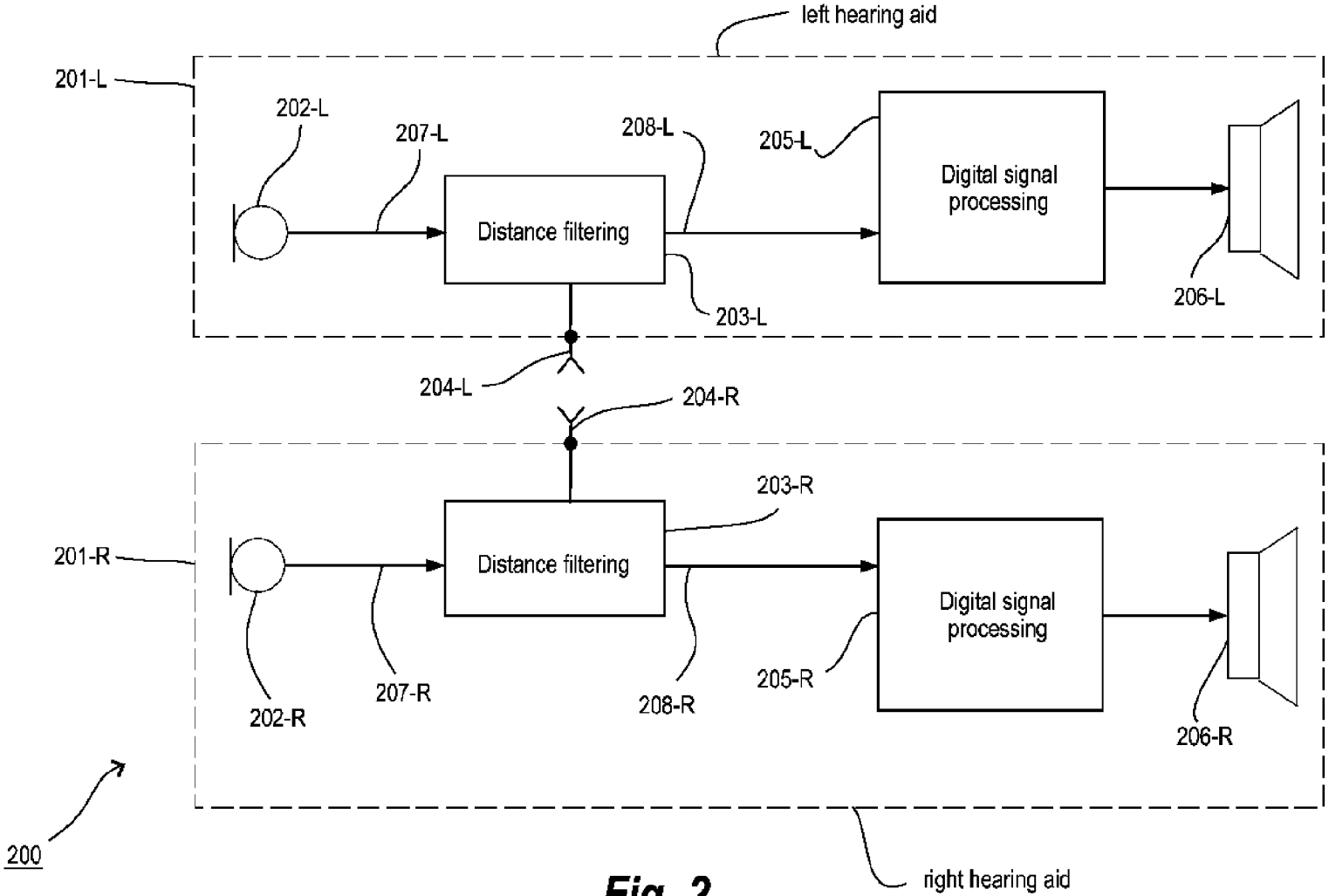
FIG. 2 illustrates highly schematically a binaural hearing aid system according to an embodiment of the invention.

Reference is now made to FIG. 2, which illustrates highly schematically a binaural hearing aid system 200 according to an embodiment of the invention. The binaural hearing aid system 200 comprises a left hearing aid 201-L and a right hearing aid 201-R. Each of the hearing aids 201-L and 201-R comprises an input transducer 202-L and 202-R, a distance filtering processing unit 203-L and 203-R, an antenna 204-L and 204-R for providing a bi-directional link between the two hearing aids, a digital signal processing unit 205-L and 205-R and an acoustic output transducer 206-L and 206-R.

According to the embodiment of FIG. 2 the analog signals from the input transducers 202-L and 202-R are converted to digital audio signals 207-L and 207-R in left and right analog-to-digital converters (not shown), and the digital audio signals 207-L and 207-R are exchanged between the left and right hearing aids 201-L and 201-R using the bi-directional link comprising the left and right antennas 204-L and 204-R. Within the distance filtering processing units 203-L and 203-R the digital audio signals 207-L and 207-R from the left and right input transducers 202-L and 202-R are processed as already described with reference to FIG. 1. In order to secure synchronization of the digital audio signals 207-L and 207-R the ipse-lateral digital audio signal is delayed with respect to the contra-lateral digital audio signal, hereby compensating for the delay of the contra-lateral signal due to the wireless transmission between the hearing aids. Subsequently the processed digital audio signals 208-L and 208-R provided from the distance filtering processing units 203-L and 203-R are input to the corresponding digital signal processing units 205-L and 205-R for further hearing aid processing, e.g. amplification according to the users prescription.

Finally the output from the digital signal processing units 205-L and 205-R are operationally connected to the corresponding acoustic output transducers 206-L and 206-R, hereby providing acoustical signals for stimulation of the corresponding tympanic membranes of the user wearing the binaural hearing aid system.

The embodiment according to FIG. 2 provides a binaural hearing aid system where the wireless transmission of data is bi-directional and requires a relative high data bandwidth. The embodiment of FIG. 2 also requires that both digital audio signals 207-L and 207-R are transformed, in both hearing aids, from the time domain and into the time-frequency domain, which are transformations that require considerable processing power.

According to the embodiment of FIG. 2 the digital audio signal is sampled at a rate of 44 kHz with a resolution of 16 bits. Therefore the required bandwidth for bi-directional transmission of these data becomes 1400 kbit/s. In a variation of the embodiment of FIG. 2 the required bandwidth can be reduced to 512 kbit/s at a sampling rate of 16 kHz.

Obviously the requirements to the bandwidth can be further reduced by introducing coding of the transmitted data. Further details concerning the use of audio-coding in a hearing aid can be found in e.g. unpublished patent application PCT/DK2009/050274 filed on Oct. 15, 2009, published as WO-A1-2011/044898.

In a variation of the embodiment of FIG. 2, only the digital audio signal from the contra-lateral hearing aid is wirelessly transmitted to the ipse-lateral hearing aid, and the modified gain $G_s(m,k)$ is determined in the ipse-lateral hearing aid. The modified gain is directly applied to the time-frequency distribution of the ipse-lateral digital audio signal and wirelessly transmitted back to the contra-lateral hearing aid where it is applied to the time-frequency distribution of the contra-lateral digital audio signal. Hereby processing power in the binaural hearing aid system is saved relative to the embodiment of FIG. 2, and the requirements to the available data bandwidth of the bi-directional wireless transmission link are relaxed at the cost of longer processing time delay because data is transmitted twice across the wireless link.

In further variations of the embodiment of FIG. 2, the time-frequency distribution of the digital audio signals are exchanged between the left and right hearing aids 201-L and 201-R. According to the embodiment of FIG. 1 the time-frequency distribution is sampled at a rate of approximately 330 Hz, where each sample contains 192 frequency bins consisting of 16 bits. Therefore the required bi-directional bandwidth for transmission of the raw time-frequency distribution data becomes 2000 kbit/s. This can be reduced to 1000 kbit/s by only transmitting half of the symmetrical spectrum.

In a further variation of the embodiment of FIG. 2, only selected parts of the time-frequency distribution of the digital audio signals are exchanged between the left and right hearing aids 201-L and 201-R. Hereby the requirement to the available bandwidth of the wireless transmission link is further relaxed compared to the embodiment of FIG. 2. According to a variation the exchange of the low frequency parts of the time-frequency distribution are discarded since the value representing the interaural coherence is approximately constant for these frequency parts in most environments. As an example all the frequency bins below 400 Hz are discarded.

In a further variation of the embodiment of FIG. 2, the time-frequency distribution is modeled by some mathematical function or by an all-pass-filter. By only exchanging the characteristical parameters of the mathematical function or the coefficients of the all-pass filter the required bandwidth can be further reduced.

In yet another variation of the embodiment of FIG. 2, only the time-frequency distribution from the contra-lateral hearing aid is wirelessly transmitted to the ipse-lateral hearing aid, and only the calculated modified gain in the third octave filter banks is transmitted back to the contra-lateral hearing aid.

Generally the requirements to the available bandwidth can be further relaxed by decreasing the precision and resolution of the transmitted data. This can be done without significantly impairing the sound quality of the hearing aid system.

Figure 6:
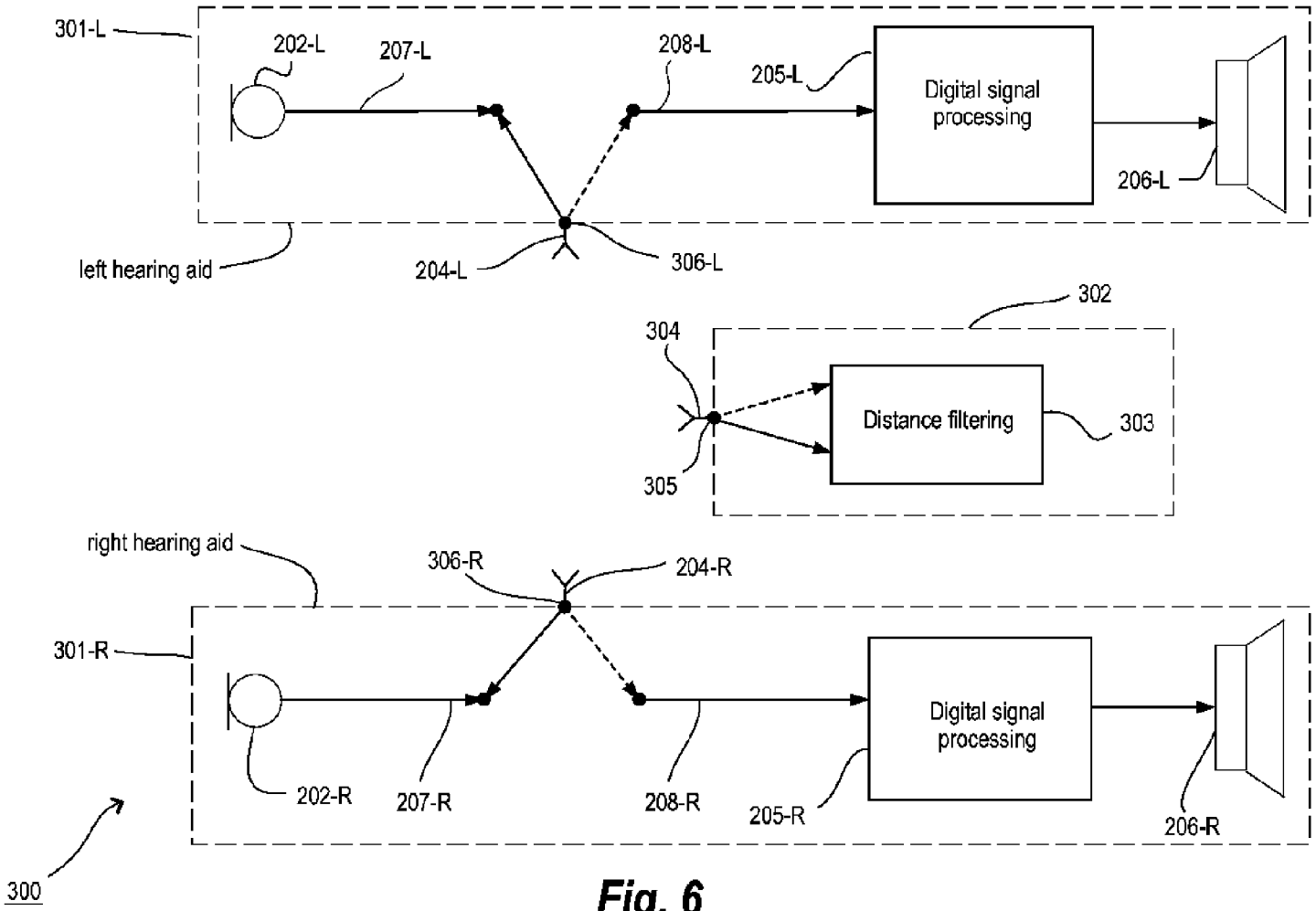
FIG. 6 illustrates highly schematically a binaural hearing aid system, including an external device, according to an embodiment of the invention.

Reference is now made to FIG. 6, which illustrates highly schematically a binaural hearing aid system 300 according to an embodiment of the invention. The binaural hearing aid system 300 comprises a left hearing aid 301-L, a right hearing aid 301-R and an external device 302. Each of the hearing aids 301-L and 301-R comprises an input transducer 202-L and 202-R, a switching means 306-L and 306-R, an antenna 204-L and 204-R for providing a bi-directional link between the two hearing aids 301-L, 301-R and the external device 302, a digital signal processing unit 205-L and 205-R and an acoustic output transducer 206-L and 206-R. The external device 302 comprises an antenna 304, switching means 305 and distance filtering processing unit 303.

According to the embodiment of FIG. 6 the analog signals from the input transducers 202-L and 202-R are converted to digital audio signals 207-L and 207-R in left and right analog-to-digital converters (not shown) and the digital audio signals 207-L and 207-R are transmitted to the external device 302 using the bi-directional link comprising the antennas 204-L, 204-R and 304. A switching means 305 in the external device 302 provides the digital audio signals 207-L, 207-R to the distance filtering processing unit 303, where the digital audio signals 207-L and 207-R are processed as already described with reference to FIG. 1. Subsequently the processed digital audio signals 208-L and 208-R provided from the distance filtering processing unit 303 in the external unit 303 are wirelessly transmitted back to the corresponding hearing aids 301-L, 301-R for further processing in the corresponding digital processing units 205-L and 205-R. Finally the outputs from the digital signal processing units 205-L and 205-R are operationally connected to the corresponding acoustic output transducers 206-L and 206-R, hereby providing acoustical signals for stimulation of the corresponding tympanic membranes of the user wearing the binaural hearing aid system. Hereby processing power is saved in the hearing aids 301-R, 301-L relative to the embodiment of FIG. 2 because the power consuming calculations are accommodated in the external device 302, that has less strict requirements with respect to the battery size and therefore to the power consumption.

Figure 3:
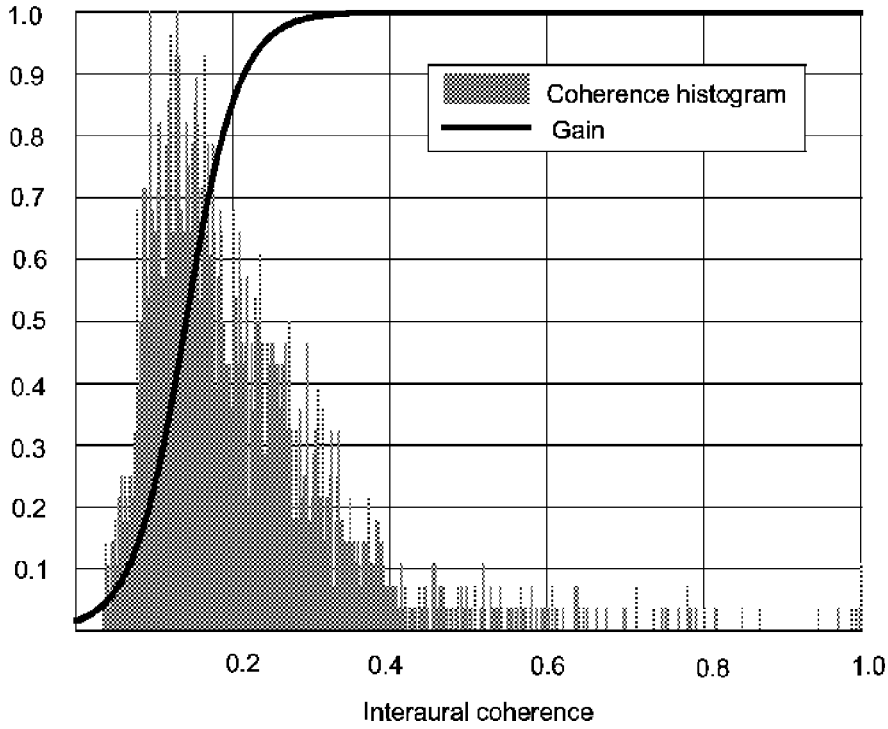
FIG. 3 illustrates a computer simulation of the interaural coherence distribution and corresponding gain value, in a hearing aid system according to an embodiment of the invention, where the hearing aid system is worn by a user in a large room with a distant speaker.

Reference is now made to FIG. 3, which illustrates a computer simulation of the interaural coherence distribution in a hearing aid system according to an embodiment of the invention, for a frequency of 1.7 kHz, where the hearing aid system is worn by a user in a large room with a distant speaker positioned 5 meters away from the user. For simplicity the distant speaker is modeled as an omni-directional source. The coherence distribution is represented by a histogram of the calculated interaural coherence values. FIG. 3 also shows the gain value calculated according to an embodiment of the invention.

FIG. 3 illustrates how the coherence distribution, resulting from a distant speaker located in a large room, has a significant peak for low values of the interaural coherence.

Figure 4:
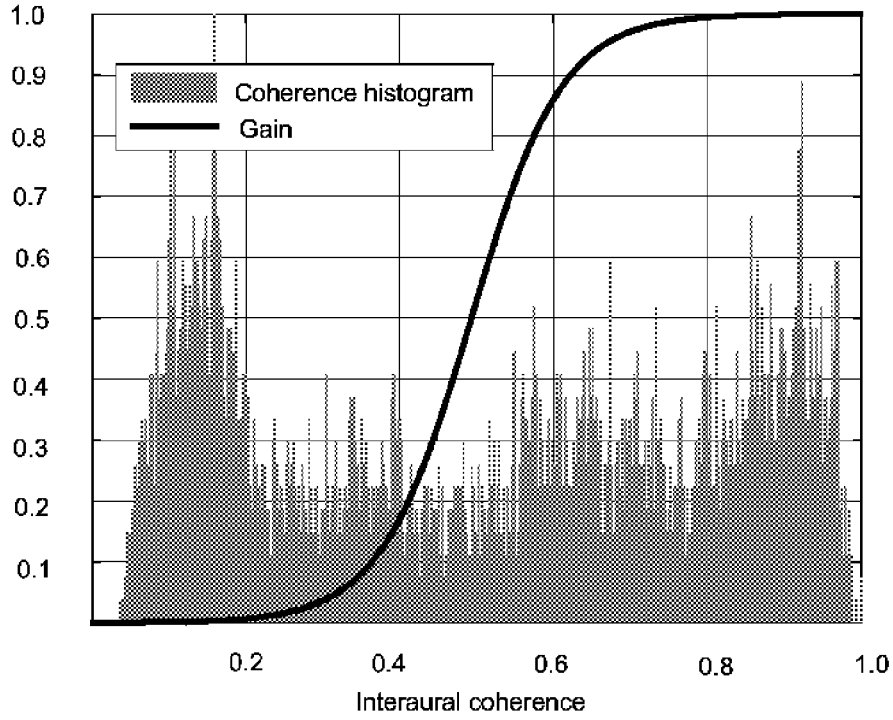
FIG. 4 illustrates a computer simulation of the interaural coherence distribution and corresponding gain value, in a hearing aid system according to an embodiment of the invention, where the hearing aid system is worn by a user in a large room with a nearby speaker.

Reference is now made to FIG. 4, which illustrates a computer simulation of the interaural coherence distribution in a hearing aid system according to an embodiment of the invention, for a frequency of 1.7 kHz, where the hearing aid system is worn by a user in a large room with a nearby speaker positioned only 0.5 meters away from the user. For simplicity the distant speaker is modeled as an omni-directional source. The coherence distribution is represented by a histogram of the calculated interaural coherence values. FIG. 4 also shows the gain value calculated according to an embodiment of the invention.

FIG. 4 illustrates how the coherence distribution, resulting from a nearby speaker located in a large room, has a significantly more uniform coherence distribution compared to the coherence distribution of FIG. 3.

Figure 5:
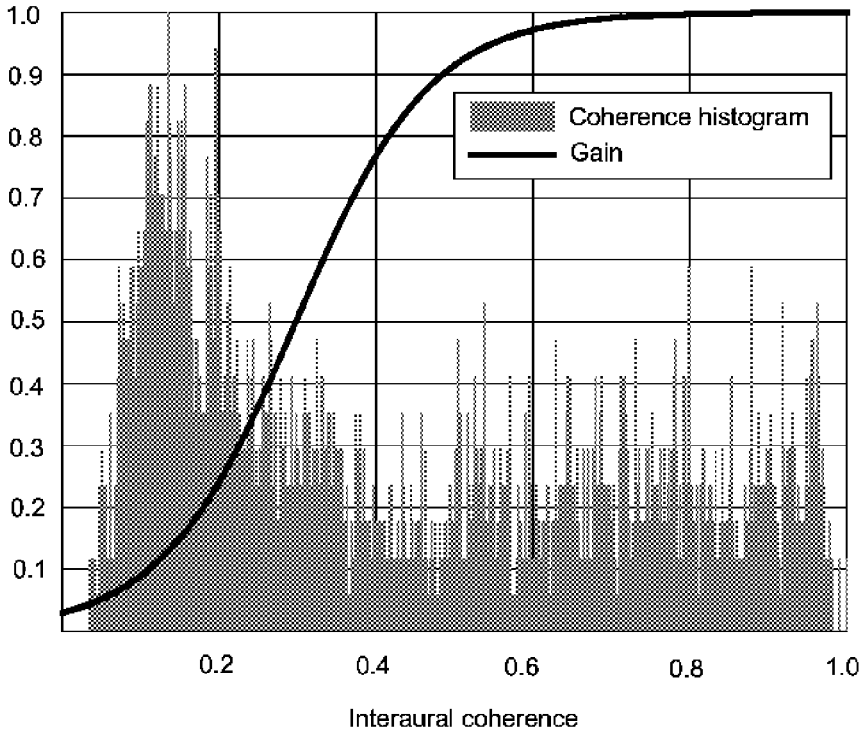
FIG. 5 illustrates a computer simulation of the interaural coherence distribution and corresponding gain value, in a hearing aid system according to an embodiment of the invention, where the hearing aid system is worn by a user in a large room with both the distant and the nearby speaker.

Reference is now made to FIG. 5, which illustrates a computer simulation of the interaural coherence distribution in a hearing aid system according to an embodiment of the invention, for a frequency of 1.7 kHz, where the hearing aid system is worn by a user in a large room with both a distant and nearby speaker. FIG. 5 also shows the gain value.

FIG. 5 illustrates how the gain calculated according to the embodiment of FIG. 1 effectively suppresses the distant speaker while leaving the nearby speaker with close to full gain.

The gain curve represents a type of sigmoid function. This yields a gain function that is well suited for effectively suppressing signal parts with a low interaural coherence while maintaining the signal parts with a high interaural coherence.

In variations of the embodiment of FIG. 1 other types of step functions are used for calculating the gain, such as a generalised logistic function.

In general terms it is required that the function used for calculating the gain as a function of the values representing the interaural coherence is characterized by comprising three contiguous ranges for the values representing the interaural coherence, where the maximum slope in the first and third range are smaller than the maximum slope in the second range, and wherein the ranges are defined such that the first range comprises the values representing the lowest interaural coherence values, the third range comprises the values representing the highest interaural coherence values, and the second range comprises the values representing the intervening interaural coherence values.

Other modifications and variations of the structures and procedures will be evident to those skilled in the art.

We claim:

1. A method for processing signals in a hearing aid system comprising the steps of:

providing a first signal representing the output from a first input transducer in a first hearing aid of the hearing aid system;

providing a second signal representing the output from a second input transducer of the hearing aid system;

transforming the first and second signal from the time domain and to the time-frequency domain hereby providing a third and fourth signal, respectively;

calculating a value representing the interaural coherence between the third and fourth signal hereby providing a fifth signal;

deriving a first gain value for the hearing aid system based on the fifth signal;

applying the first gain value in the amplification of the third signal in the first hearing aid hereby providing a sixth signal;

transforming the sixth signal from the time-frequency domain and to the time domain hereby providing a seventh signal for further processing in the hearing aid system; and wherein the relation determining the first gain value as a function of the value representing the interaural coherence comprises three contiguous ranges for the values representing the interaural coherence, where the maximum slope in the first and third range are smaller than the maximum slope in the second range and wherein the ranges are defined such that the first range comprises values representing low interaural coherence values, the third range comprises values representing high interaural coherence values, and the second range comprises values representing intermediate interaural coherence values.

2. The method according to claim 1, comprising the steps of:

applying a second gain value in the amplification of the seventh signal for compensating a hearing deficiency of a hearing aid user hereby providing an eighth signal, wherein the second gain value is calculated based on the users prescription; and providing a first acoustical signal from the first hearing aid based on the eighth signal.

3. The method according to claim 1 comprising the steps of:

applying the first gain value in the amplification of the fourth signal hereby providing a ninth signal;

transforming the ninth signal from the time-frequency domain and to the time domain hereby providing a tenth signal for further processing in the hearing aid system; and applying a third gain value in the amplification of the tenth signal for compensating a hearing deficiency of a hearing aid user hereby providing an eleventh signal; wherein the third gain value is calculated based on the users prescription; and providing a second acoustical signal from a second hearing aid of the hearing aid system based on the eleventh signal.

4. The method according to claim 1, wherein the formula used for derivation of the first gain value is adaptive.

5. The method according to claim 1, comprising the steps of calculating statistical characteristics of the fifth signal and using the statistical characteristics of the fifth signal in determining the formula used for deriving the first gain value.

6. The method according to claim 1, comprising the step of using an acoustic scene classifier in determining the formula used for deriving the first gain value.

7. The method according to claim 1, comprising the step of determining the formula used for deriving the first gain value based on input from the user of the hearing aid system.

8. The method according to claim 1, wherein the value representing the interaural coherence is calculated based on a first time-averaged auto-correlation $G_{11}(m,k)$ of the estimated time-frequency distribution of the first signal, a second time-averaged auto-correlation $G_{22}(m,k)$ of the estimated time-frequency distribution of the second signal, and a time-averaged cross-correlation $G_{12}(m,k)$ of the estimated time-frequency distributions of the first and the second signals.

9. The method according to claim 1, wherein the derivation of the first gain value is adapted for suppressing signals with a low interaural coherence whereby sound sources beyond a certain distance from the wearer of the hearing aid system can be suppressed.

10. The method according to claim 1, wherein the derivation of the first gain value is adapted for suppressing signals with a low interaural coherence whereby sound sources whose directivity is not primarily pointing towards the wearer of the hearing aid system can be suppressed.

11. A hearing aid system comprising at least one hearing aid, two microphones, an analogue-to-digital converter component, a time-frequency transforming component, an interaural coherence calculation component, a first gain calculation component configured for suppressing interfering speakers, a digital processing component configured for alleviating a hearing deficit of the user wearing the hearing aid system, a digital-to-analogue converter component, and an output transducer component for providing an acoustical signal, wherein the first gain calculation component is adapted for using a relation determining a first gain value as a function of a value representing the interaural coherence comprising three contiguous ranges for the values representing the interaural coherence, where the maximum slope in the first and third range are smaller than the maximum slope in the second range, and wherein the ranges are defined such that the first range comprises values representing low interaural coherence values, the third range comprises values representing high interaural coherence values, and the second range comprises values representing intermediate interaural coherence values.

12. A hearing aid system comprising a hearing aid and an external device, said hearing aid having a microphone, an analogue-to-digital converter component, a time-frequency transforming component, an interaural coherence calculation component, a first gain calculation component adapted for suppressing interfering speakers, a digital processing component adapted for alleviating a hearing deficit of the user wearing the hearing aid system, a digital-to-analogue converter component, and an output transducer for providing an acoustical signal, and said external device having an acoustical-electrical input transducer and a link for transmitting data derived from the input transducer to the hearing aid, wherein the first gain calculation component is adapted for using a relation determining a first gain value as a function of a value representing the interaural coherence comprising three contiguous ranges for the values representing the interaural coherence, where the maximum slope in the first and third range are smaller than the maximum slope in the second range, and wherein the ranges are defined such that the first range comprises values representing low interaural coherence values, the third range comprises values representing high interaural coherence values, and the second range comprises values representing intermediate interaural coherence values.

* * * * *